United States Patent [19]

Ohashi

[11] Patent Number: 4,507,880

[45] Date of Patent: Apr. 2, 1985

[54] BOOT CONTAINING VENTILATION MEANS

[75] Inventor: Kazuo Ohashi, Tokyo, Japan

[73] Assignee: Kabushiki Kaisha Patine Shokai, Tokyo, Japan

[21] Appl. No.: 458,961

[22] Filed: Jan. 18, 1983

[30] Foreign Application Priority Data

Sep. 9, 1982 [JP] Japan ..... 57-135963[U]
Oct. 26, 1982 [JP] Japan ..... 57-186725

[51] Int. Cl.[3] ..... A43B 5/16

[52] U.S. Cl. ..... 36/115; 36/3 B; 36/3 R

[58] Field of Search ..... 36/115, 3 B, 3 R, 3 A

[56] References Cited

U.S. PATENT DOCUMENTS

| | | | |
|---|---|---|---|
| 220,475 | 10/1879 | Hannaford | 36/3 R |
| 417,858 | 12/1889 | Church | 36/3 B |
| 663,270 | 12/1900 | Hallanon | 36/3 R |
| 991,457 | 5/1911 | Roberts | 36/3 R |
| 997,658 | 9/1911 | Duncan | 36/3 R |
| 1,103,874 | 7/1914 | Halley | 36/3 R |
| 1,236,924 | 8/1917 | Golden | 36/3 B |
| 1,480,234 | 3/1922 | Wedd | 36/3 B |
| 1,742,460 | 7/1927 | Creery | 36/3 R |
| 1,974,456 | 9/1934 | Goldzweig | 36/3 R |
| 2,207,632 | 7/1940 | Margolin | 36/3 R |
| 3,061,950 | 11/1962 | Levine . | |
| 4,102,061 | 7/1978 | Saaristo | 36/3 B |
| 4,194,041 | 3/1980 | Gore et al. | 2/167 |
| 4,290,211 | 9/1981 | Csengeri . | |

FOREIGN PATENT DOCUMENTS

| | | | |
|---|---|---|---|
| 1915442 | 10/1970 | Fed. Rep. of Germany . | |
| 2816189 | 8/1979 | Fed. Rep. of Germany | 36/3 B |
| 2116790 | 7/1972 | France . | |
| 2410448 | 8/1979 | France | 36/3 B |

*Primary Examiner*—Werner H. Schroeder
*Assistant Examiner*—Mary A. Ellis
*Attorney, Agent, or Firm*—Frishauf, Holtz, Goodman & Woodward

[57] ABSTRACT

Described is a sports boot such as ice skate boot or ski boot which is both water-proof and air permeable and which is comprised of a boot-shaped substrate formed of natural or synthetic leather or other similar pliant material, an outer sheath formed of synthetic material and applied integrally to the outer side of the substrate, air permeable members or units provided in suitable portions in the sole part of the sheath and having ventilation holes providing for communication between the inside and outside of the sheath, and porous films or sheets made water-proof air permeable layers or sheets of porous synthetic resin material provided between side substrate and the sheath in portions where at least the ventilation holes are provided.

8 Claims, 14 Drawing Figures

FIG. 7
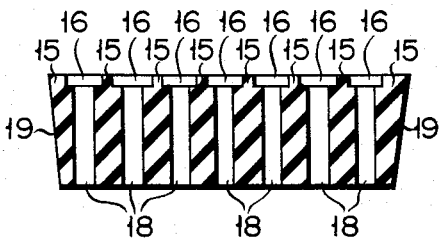
FIG. 8
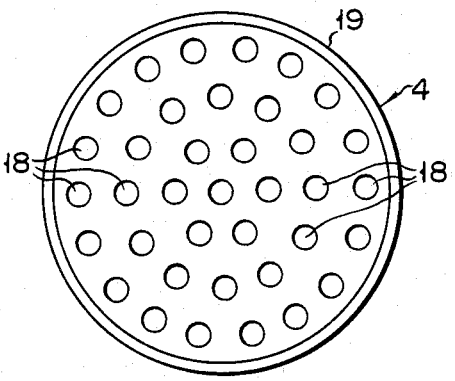
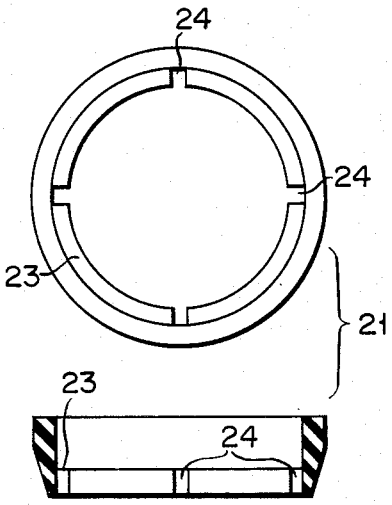
FIG. 9

BOOT CONTAINING VENTILATION MEANS

BACKGROUND OF THE INVENTION

This invention relates to a boot and especially to a boot suited for sports such as ice skating or skiing. More particularly, it relates to such boot having water-proofness and air permeability, and comprised of a substrate formed of natural leather, synthetic leather or other similar soft and pliable material in the shape of a shoe and an outer sheath formed of synthetic material and applied to the outside of the substrate.

Boots comprised of a substrate formed of soft and pliable material such as natural or synthetic leather in the shape of a shoe, and an outer sheath formed of synthetic material and applied to the outside of the substrate, is known in the art. Especially, ice skate boots, ski boots or other sport boots comprised of such substrate of soft material such as natural or synthetic leather and an outer sheath of synthetic material applied to the outside of the substrate have been proposed for reducing manufacture costs and heightening durability, abrasion resistancy, air-tightness, heat retaining property and stability of the boots.

Such boots are excellent in durability, abrasion resistance, water-proofness, heat retaining property, stability and protection of the users' feet, because the outer side of the substrate is covered with the outer sheath of synthetic material. There is however such shortcoming that the users' feet may sweat on account of poor air permeability giving rise to bad sweating odor.

Furthermore, in case of a boot in which the substrate in the form of a shoe and the outer sheath of synthetic material are fabricated separately and the substrate is introduced into the sheath when the user wears the boots, it is necessary for the user to get these two components properly matched to each other which takes considerable laborious work.

SUMMARY OF THE INVENTION

In consideration of the abovementioned inconveniences of the prior art, it is an object of the present invention to provide a boot which is excellent not only in durability, abrasion resistance, heat retaining property, water-proofness, stability and protection of the users' feet, but which also provides air permeability, and which may be manufactured at low costs and makes it possible to dispense with the labor of matching the substrate and the sheath to each other at each time when the user wears the boot.

In accordance with the present invention, there is provided a boot which is comprised of an air permeable boot-shaped substrate and made of a soft and pliable material, an outer sheath of synthetic material applied in situ to the outside of said substrate, air permeable means provided in suitable portions of the sole part of the outer sheath and having ventilation holes providing for ventilation between the inside and outside of said outer sheath, and water-proof air permeable layers of a porous synthetic material provided at least to portions corresponding to said ventilation holes in said air permeable means between said substrate and the outer sheath. In summary, the air permeable members or units formed of a synthetic material are provided in suitable portions of the sole part of the outer sheath and formed integrally therewith. These air permeable members or units are formed with a multiplicity of ventilation holes arranged in radial configuration and facing said substrate, and intermediate layers or sheets of porous synthetic material are provided between said substrate and the outer sheath at least in portions corresponding to said ventilation holes, for affording air permeability to the boot without affecting its water-proofness.

BRIEF DESCRIPTION OF THE DRAWINGS

FIG. 7 is a section taken along line VI—VI of FIG. 6.

FIG. 8 is a bottom view of the air permeable member.

FIGS. 9 to 11 show an air permeable unit composed of a frame and an air permeable disc, wherein FIG. 9 shows the frame in plan view and sectional view, FIG. 10 shows the frame in plan and sectional view and FIG. 11 shows the air permeable disc fitted to the frame in front view, with a portion thereof being cut away.

FIGS. 12 to 14 show a modified air permeable unit composed similarly of a frame and an air permeable disc, wherein FIG. 12 shows the frame in plan and sectional view, FIG. 13 shows the disc in plan and sectional view and FIG. 14 shows the air permeable disc fitted to the frame with a portion thereof being cut away.

DESCRIPTION OF PREFERRED EMBODIMENTS

Figure 1:
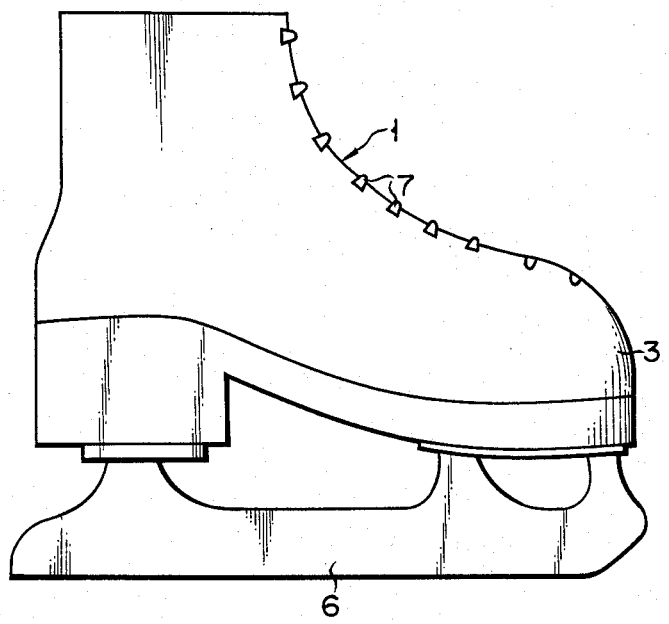
FIG. 1 is an overall side elevation of a skate boot according to the present invention.
Figure 2:
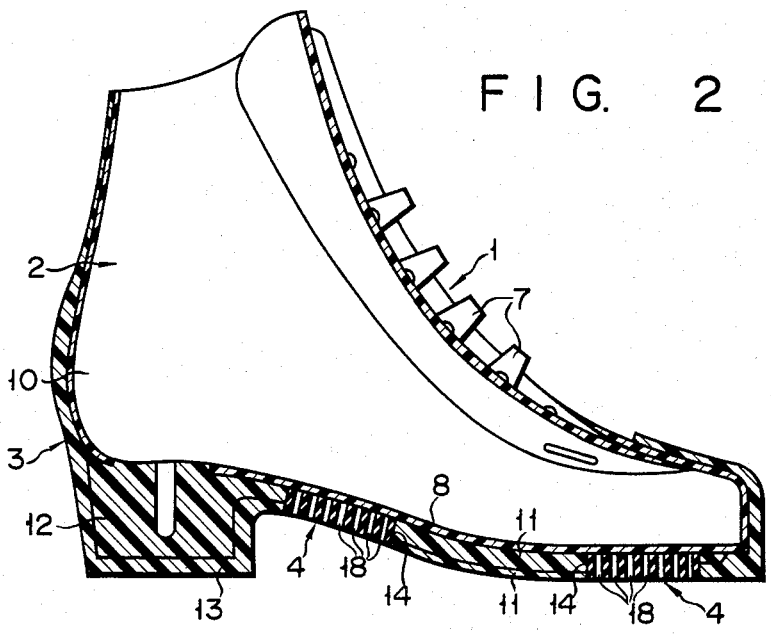
FIG. 2 is a side view, shown partly in section, with the skate blade removed.

In the accompanying drawings, a skate boot as an embodiment of the present invention used for ice skating is illustrated and generally shown in FIGS. 1 and 2 as numeral 1. The boot 1 is comprised of an air permeable boot-shaped substrate 2 and is made of a soft and pliable material, an outer sheath 3 made of a synthetic material forming an outer cover of the substrate 2, air permeable members 4 provided at the sole part of the outer sheath 3 and having a multiplicity of ventilation through-holes 18, porous intermediate layers 5 (FIG. 4) provided between said substrate 2 and the outer sheath 3 at least in portions or areas coextensive as the through-holes 18 of the air permeable members, 4 and a skate blade 6 mounted to the outsole of the sheath 3. The numeral 7 in the drawing denotes metal hooks for engaging a bootstring (not shown).

Figure 3:
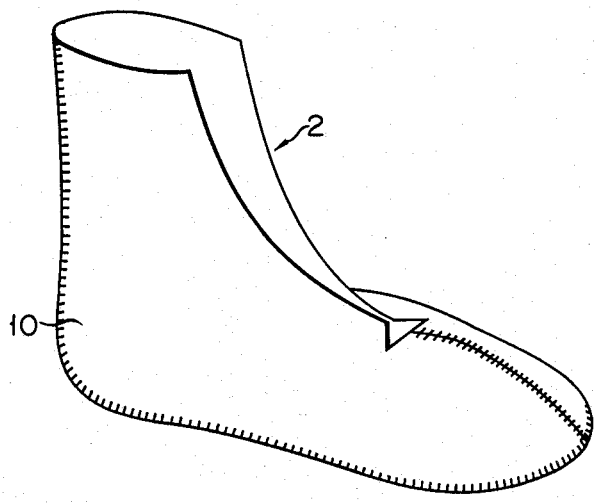
FIG. 3 is a perspective view of a substrate.
Figure 4:
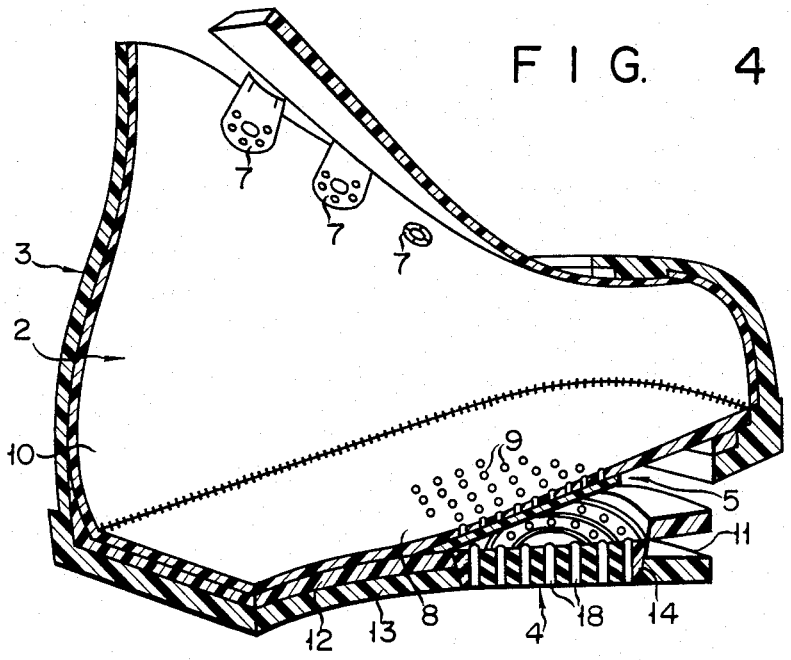
FIG. 4 is a perspective view of the boot with the sole part thereof being peeled apart and certain portions being shown in section.
Figure 5:
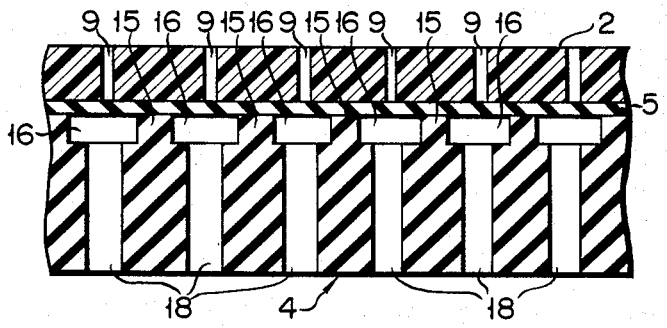
FIG. 5 is an enlarged sectional view showing essential portions of the sole part.
Figure 6:
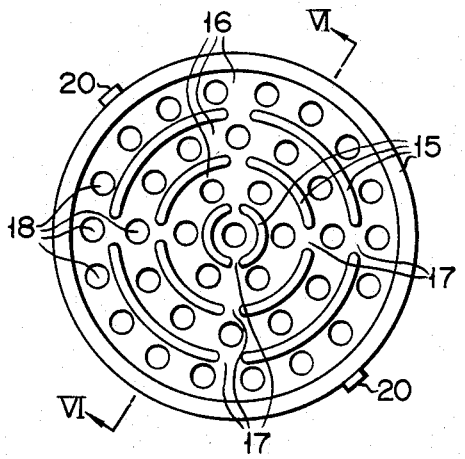
FIG. 6 is a plan view of an air permeable member.

The substrate 2 takes the form of a boot or shoe as shown in FIG. 3 and may be made of soft and pliable material such as natural leather or synthetic leather. Fiberous materials may also be employed if desired. The substrate 2 is preferably endowed with air permeability. When an air impermeable material is employed as substrate material, it is necessary to provide a multiplicity of small openings 9 as shown in FIGS. 4 and 5 for permitting circulation of air. These openings 9 are preferably bored in a predetermined area of a sole part 8. The entire substrate 2 does not have to be made of one and the same material. Thus the sole part 8 can be made of harder material than a side portion 10 depending on the purposes and functions of the shoe.

The outer sheath 3 made of synthetic material is formed in situ around the outer side of the substrate 2, and the air permeable member 4 is fitted into an opening in the sole part 11 of the outer sheath 3.

As shown in FIGS. 2 and 4, the outer sheath 3 has the shape of a shoe or boot in its entirety and is formed in situ and integrally with the substrate 2. In sport boots, above all, it is generally preferred that certain portions such as side and so-called crescent-shaped portions be rigid to some extent, while other portions such as the periphery of the sole part 11 be soft and pliable to some extent, in consideration of their operating functions. Hence, the outer sheath 3 is preferably formed in situ around the outer side of the substrate 2 so that the abovementioned requirements be satisfied. In FIGS. 3 and 4, a portion of the sheath 3 designated by the reference numeral 12 is formed of harder plastic material, while another portion designated by the reference numeral 13 is formed of softer plastic material.

The air permeable member 4 fitted into the mating opening in the sole portion 11 of the outer sheath 3 is formed of natural rubber, synthetic rubber or other synthetic material. Preferably, the air permeable member 4 is formed of a synthetic material having certain resiliency and being of the same type as the synthetic material of the outer sheath 3. The air permeable member 4 is designed and arranged as shown for examples in FIGS. 5 to 8. Thus the member 4 has the overall shape of a disc and has an upper surface or a surface facing the substrate 2 formed with a series of annular arrays of ribs 15 and a series of annular grooves 16 alternately and concentrically with respect to one another. Each of said ribs 15 is interrupted at predetermined points by cut-outs 17 through which two neighboring grooves 16 on both sides of the ribs 15 communicate with each other. A multiplicity of the ventilation through-holes 18 are formed in an overall radial pattern in the region of the grooves 16. These through-holes 18 are bored through the air permeable member 4 to provide for ventilation between the inside and outside of the outer sheath 3. The outer side wall of the air permeable member 4 is tapered as at 19 from the top towards the bottom. The function of the tapered outer wall 19 is intended to hold the air permeable member 4 against any incidental dropping off from the outer sheath 3. If desired, suitable bosses 20, 20 may be provided to the upper portion of the outer side wall of the member as means for more secure holding of the air permeable member 4.

The upper surface of the air permeable member 4, that is, the surface on which are provided said ribs 15 and grooves 16, faces the substrate 2 having air permeability, through the medium of intermediate layers 5 formed of porous synthetic material to be later described, in such a manner that the ribs 15 are brought into contact with the air permeable intermediate layers 5. The result is that the ventilation through-holes 18 formed in the grooves 16 of the air permeable members 4 face the substrate 2 through the intermediary of the porous layers 5 to provide for ventilation of the inside of the skate boot 1 through ventilation through-holes 18 of the air permeable members 4, the layers 5 and the substrate 2. In cases where the substrate 2 is not formed of air permeable material, ventilation is provided by the small openings 9 formed in the sole part 8 of the substrate 2. Preferably, these small openings 9 are formed radially in the sole part 8 in registry with respective ones of the through-holes 18 of the air permeable member 4. By providing these small openings 9 in the radial configuration, the ventilation through-holes 18 and the small openings 9 can communicate easily with one another through the porous intermediate layers 5. Even when the ventilation through-holes 18 and the small openings 9 are not correctly in register with one another, the grooves 16 and cut-outs 17 of the air permeable members 4 act as channel providing for communication therebetween so that good ventilation can be maintained in the inside of the boot 1 and the labor of precisely aligning the small openings 9 and ventilation through-holes 18 may be dispensed with.

Figure 10:
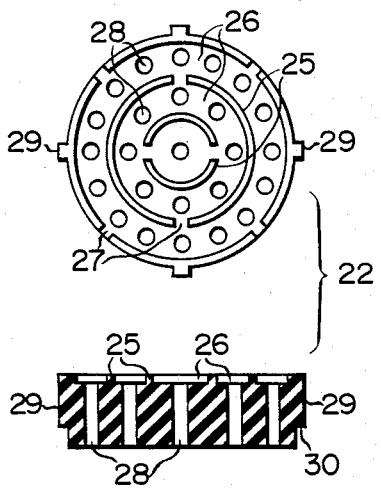
Figure 11:
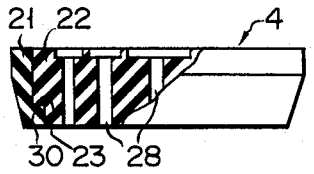

According to another embodiment of the invention, an air permeable unit 4 provided to the sole part 11 of the outer sheath 3 may be formed by a frame 21 secured to the outer sheath and an air permeable disc 22 having ventilation through-holes 28 and removably fitted to the frame 21, as shown in FIGS. 9 to 11. The frame 21 is formed of natural rubber, synthetic rubber or other resilient synthetic material and shaped as a ring. The frame 21 has a tapered outer peripheral surface such that the inner bottom side is of larger diameter and the outer bottom side is of lesser diameter. The inner peripheral surface of the frame 21 on the lesser diameter side or outer bottom side is formed integrally with a lug 23 in the form of a flange provided with e.g. four notches 24 at suitable intervals. The air permeable disc 22 is formed of the same material as the frame 21 and provided on its inner bottom side surface with substantially annular arrays of ribs 25 and grooves 26 alternately and concentrically with one another. Each annular aray of the ribs 25 is interrupted at predetermined points by cut-outs 27 providing for communication between neighboring ones of the grooves 26. A multiplicity of ventilation through-holes 28 are bored through these grooves of the air permeable disc 22. The outer lateral surface on the inner bottom side of the disc 22 is formed with ribs 29 that register with the notches 24 of the frame 21 and that are provided with stepped portions 30 at the lower ends for locking the disc 22 relative to the frame 21. Thus the disc 22 is introduced into the inside of the frame 21, with the disc 22 placed opposite to the outer bottom side of the frame 21 and with the ribs 29 aligned with the notches 24. The disc 22 is introduced until the ribs 29 lie beyond the notches 24. The disc 22 is then turned a predetermined angle for locking the stepped portions 30 with the lug 23 of the frame 21. When it is desired to take out the disc 22 from the frame 21, the disc 22 turned the predetermined angle until the ribs 29 again register with the notches 24, and the disc 22 can then be pulled out from the outer bottom side of the frame 21. In this manner, the disc 22 can be easily mounted to and detached from the frame 21.

Figure 12:
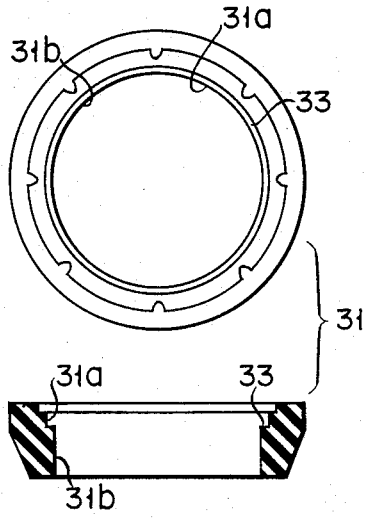
Figure 13:
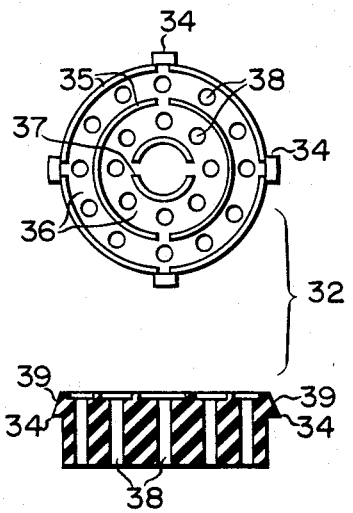
Figure 14:
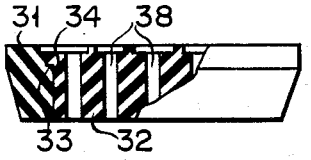

The above frame and air permeable disc that make up the air permeable unit 4 may be arranged as shown in FIGS. 12 to 14. In the drawing, the numerals 31, 32 designate a frame in the form of a ring and the air permeable disc, respectively. The frame 31 has a tapered outer peripheral surface with the inner bottom side being of larger diameter and the outer bottom side being of lesser diameter. The inner peripheral surface on the larger diameter portion of the frame 31 is formed as a larger diameter portion 31*a*, and a lug 33 is provided between the portion 31*a* and a lesser diameter portion 31*b*. The outer peripheral surface on the inner bottom side of the disc 32 is formed for example with four bosses 34 at suitable intervals from one another. Each boss 34 is triangular in longitudinal cross-section and has a beveled surface 39 having a falling gradient towards the inner bottom side of the disc 32. The disc 32 is first positioned with the bosses 34 thereof facing the lesser diameter portion 31*b* of the frame 31. The disc 32 is then pressed into the inside of the frame 31 through utilization of resiliency of the disc 32. At this time, the bosses 34 yield through resiliency and may be inserted into the frame 31 without resistance because of the presence of the beveled surfaces 39 having a falling gradient towards the inner bottom side, that is, in the direction of insertion of the disc 32. When the disc 32 has been inserted to a certain depth, the bosses 34 lie beyond the lesser diameter portion 31*b* and are located in the larger diameter portion 31*a* where they resume their original state. In this manner, the disc 32 is locked in position in the frame 31. Similarly to the preceding embodiment, the disc 32 is formed with a multiplicity of ventilation through-holes 38, and the surface of the disc 32 has annular arrays of ribs 35, annular arrays of grooves 36 and cut-outs 37 in the grooves 36. When it is desired to take out the disc 32 from the frame 31, a suitable gouging tool may be inserted into one of the through-holes 38 for extracting the disc 32 from the frame 31. The result is that the disc 32 can be easily attached to and detached from the frame 31.

The air permeable unit 4 of the present embodiment is mounted to the outer sheath 3 similarly to the preceding embodiment and therefore the description therefore is omitted for simplicity.

The above arrangement of the air permeable unit 4 consisting of the frame and the disc is convenient in that, when the disc is stopped up with dust or dirt, it can be readily detached from the frame for cleaning or replacement. Such air permeable units 4 are provided in suitable places in the sole part 11 of the outer sheath 3.

The water-proof and air permeable intermediate sheets 5 formed of porous synthetic material are provided between the substrate 2 and the sheath 3 at least in portions registering with the respective ventilation through-holes 18, 28, 38 of the air permeable member 4. Porous synthetic material such as tetrafluoroethylene polymer, especially polytetrafluoroethylene or fluorocarbon polymer are processed into a film which may then be bonded or otherwise adhered to the outer surface of the substrate 2. Alternatively, the above material may be laminated to the substrate 2. Still alternatively, fibers of synthetic material may be compacted under elevated pressure into a porous sheet which may then be bonded or otherwise stuck to the outer surface of the substrate 2. A wide variety of commercially available water-proof and air permeable films or sheets of porous synthetic materials may be utilized within the scope of the present invention.

The boot 1 such as described above may be manufactured for an example by the following process.

First of all, the substrate 2 is formed of leather. The sole part of the substrate 2 is made of hard leather and the side or upper is made of soft leather. The sole part 8 is formed with a multiplicity of small openings 9 when the substrate 2 is not formed of air permeable material. Then, the layers 5 of porous synthetic material are formed in situ in any suitable portions of the sole part 8 of the substrate 2.

The air permeable members or units 4 are formed as mentioned above by a metal mold. With these members 4 applied to the layers 5 of porous synthetic material laminated to the bottom surface of the substrate 2, synthetic material is cast in situ about the outer surface of the substrate 2 by relying upon injection molding. In this manner, the sheath 3 is formed as one with the substrate 2. When desired that certain portions such as lateral sides or crescent-shaped portion of the sheath 3 be rigid while other portions such as outer periphery of the sole be soft to some degree, harder synthetic material and soft or more pliable synthetic material may be injected in this order in portions assigned to them. In this manner, there is provided the boot 1 in which the substrate 2 and the outer sheath 3 are formed as one and the air permeable members 4 are also secured with the outer sheath 3.

The process of preparing the boot in case of the air permeable units 4 each formed of a frame and an air permeable disc, is as follws. The outer sheath 3 of synthetic material is cast in situ on the outer surface of the substrate 2 by primary casting by relying upon e.g. injection molding. During this primary casting, mounting openings 14 for receiving the air permeable units 4 are provided to suitable places of the sole part 11 of the outer sheath 3 for exposing the layers 5 of the porous synthetic material. The frames 21, 31 of the air permeable units 4 are then fitted into said openings 14 with a layer of adhesive placed therebetween. Since the outer sheath 3 has been subjected only to primary casting, it is of lesser thickness than the frame 21, 31 so that substantially the upper half portion of the frame 21, 31 is embedded in the resin while the lower half portion thereof is exposed and projected from the boot sole. The porous synthetic material is then cast in situ by secondary casting by relying upon injection molding until the outer sheath 3 is of substantially the same thickness as the frame 21, 31. In this manner, the frame 21, 31 is attached integrally to the outer sheath 3. Since the frame 21, 31 has the tapered outer peripheral surface, and the inner bottom side of the frame 21, 31 is of larger diameter while the outer bottom side thereof is of lesser diameter, the frame 21, 31 is not liable to be detached from the sheath 3 despite certain gap or clearance formed between the outer sheath 3 and the frame 21, 31 due to changes in the properties of the synthetic materials of the outer sheath 3 with lapse of time.

The air permeable disc 22, 32 is then inserted into the frame 21, 31 secured to the outer sheath 3 from the outer bottom side thereof in accordance with the mounting sequence described above to complete the assembly of the air permeable unit 4. Since the disc 22, 32 of the air permeable unit 4 is facing the layer 5 of the porous synthetic material, the ventilation channel is now provided by the ribs 25, 35, grooves 26, 36 and cut-outs 27, 37 formed on the surface of the air permeable disc 22, 32.

The boot 1 described above is excellent not only in durability, wear resistancy, heat retaining property and stability as the conventional boot in which the outer sheath 3 of synthetic material is simply spplied to the outer surface of the substrate 2, but also excellent in air permeability, so that the boot 1 is free from such drawbacks as steaming of the user's feet or generation of bad sweating smell. It is because the outside air which has entered through the ventilation holes 18, 28, 38, grooves 16, 26, 36 and cut-outs 17, 27, 37 of the air permeable members or units 4 may be admitted into the inside of the boot 1 through the small openings 9 in the substrate 2 and discharged to outside through the same route, thus providing for good air permeability to the boot 1. In addition, outside moisture is also kept from entering the inside of the boot 1 by reason of water-proofness of the layers 5 of the porous synthetic material.

Especially, when the air permeable unit is comprized of a frame secured to the outer sheath and an air permeable disc removably fitted to the frame, excellent air permeability may be maintained at all times because only the disc can be detached from the unit for cleaning whenever the through-holes of the disc has become congested with foreign matter such as dust or dirt.

In addition, since the substrate 2 and the outer sheath 3 are cast integrally with each other, the user needs not take trouble to match the substrate with outer sheath at each time of wearing the boot, while enabling him to obtain less expensive boot of lower manufacturing cost.

Although the foregoing description has been made about a skate boot, the present invention is not limited to such embodiment but may be employed in a wide variety of sports shoes such as skiing shoe, climbing shoe or the like.

The boot of the present invention as described and shown hereinabove has an air permeable substrate in the form of a shoe and made of a softer material, an outer sheath of synthetic material applied in situ to the outside of said substrate, air permeable members or units provided in suitable portions of the sole part of the outer sheath and having ventilation holes providing for ventilation between the inside and outside of said outer sheath, and water-proof and air permeable layers of porous synthetic material provided at least to portions corresponding to said ventilation holes in said air permeable members or units between said substrate and the outer sheath. The boot thus designed is excellent in durability, abration-resistancy, heat retaining property, water-proofness, stability and the function to protect the users' feet, while also providing for good air permeability; with the result that the user may take exercises agreeably because these is no risk that the user's feet may become steamed to give rise to bad odor. In addition, since the outer sheath is formed in situ to the outside of the substrate integrally therewith, the user needs not take trouble to get the substrate and outer sheath properly matched to each other. Moreover, the boot may be available at lower costs.

What is claimed is:

1. A boot comprising:

an air permeable boot-shaped substrate having a sole portion and being made of a soft pliable material;

an outer sheath made of a synthetic material integrally formed with said substrate and covering the outside thereof, said outer sheath having a sole part in registration with said sole portion of said substrate;

separate air permeable means provided in at least a portion of the sole part of the outer sheath and comprising a plurality of ventilation holes for ventilation between the inside and outside of said outer sheath; and at least one waterproof air-permeable layer made of a synthetic material provided between said substrate and the outer sheath in at least the portion of the sole part of the outer sheath containing said air permeable means.

2. The boot of claim 1, wherein said separate air permeable means comprises a frame secured to said outer sheath and an air permeable disc removably attached to the inside of said frame.

3. The boot of claim 2, wherein the frame of said separate air permeable means is in the form of a ring having an upper surface and having a lug on the inner peripheral surface thereof, and said air permeable disc having means for engaging said lug to provide removable attachment therewith.

4. The boot of claim 2, wherein said separate air permeable means has an upper surface comprising substantially annular arrays of ribs and grooves and said plurality of ventilation holes are provided in radial configuration in said grooves.

5. The boot of claim 4, wherein said ribs are partially interrupted by cut-outs designed for providing communication between adjacent grooves.

6. The boot as claimed in claim 1, wherein said separate air permeable means has an upper surface comprising substantially annular arrays of ribs and grooves and a plurality of said ventilation holes are provided in radial configuration in said grooves.

7. The boot as claimed in claim 6, wherein said ribs are partially interrupted by cut-outs designed for providing communication between adjacent grooves.

8. The boot as claimed in claim 1, wherein said air permeable means is removably secured to said outer sheath.

* * * * *